US006603245B1

(12) United States Patent
Fletcher

(10) Patent No.: US 6,603,245 B1
(45) Date of Patent: Aug. 5, 2003

(54) THREE-DIMENSIONAL MULTIPLE SERIES GAP SPARK PLUG

(76) Inventor: Jay W. Fletcher, 32821 Mermaid Cir., Dana Point, CA (US) 92629

( * ) Notice: Subject to any disclaimer, the term of this patent is extended or adjusted under 35 U.S.C. 154(b) by 14 days.

(21) Appl. No.: 09/619,282

(22) Filed: Jul. 19, 2000

Related U.S. Application Data

(63) Continuation of application No. 09/158,762, filed on Sep. 23, 1988, now abandoned.

(51) Int. Cl.[7] ..... H01T 13/20
(52) U.S. Cl. ..... 313/141; 313/142; 313/144
(58) Field of Search ..... 313/141, 142, 313/123, 143, 144, 132, 140

(56) References Cited

U.S. PATENT DOCUMENTS

| | | | | | |
|---|---|---|---|---|---|
| 1,191,429 | A | | 7/1916 | Jensen | 123/169 |
| 1,353,593 | A | | 9/1920 | Jorgenson | 123/169 |
| 1,660,635 | A | | 2/1928 | Thompson | 123/169 |
| 2,208,059 | A | | 7/1940 | Stahr | 123/169 |
| 3,567,987 | A | | 3/1971 | Schnurmacher | 313/123 |
| 3,577,170 | A | | 5/1971 | Nylen | 313/123 |
| 3,719,851 | A | | 3/1973 | Burley | 313/123 |
| 3,908,145 | A | | 9/1975 | Kubo | 313/123 |
| 3,921,020 | A | * | 11/1975 | Wax | 313/123 |
| 4,004,562 | A | | 1/1977 | Rado et al. | 123/169 |
| 4,004,563 | A | | 1/1977 | Nakamura et al. | 123/191 |
| 4,029,986 | A | | 6/1977 | Lara et al. | 313/123 |
| 4,109,633 | A | * | 8/1978 | Mitsudo et al. | 123/169 EL |
| 4,261,085 | A | * | 4/1981 | Nishio et al. | 445/7 |
| 4,268,774 | A | | 5/1981 | Forkum | 313/141 |
| 4,272,697 | A | * | 6/1981 | Wax | 313/123 |
| 4,400,643 | A | * | 8/1983 | Nishio et al. | 313/11.5 |
| 4,539,503 | A | * | 9/1985 | Esper et al. | 313/11.5 |
| 4,659,960 | A | * | 4/1987 | Toya et al. | 313/141 |
| 5,493,171 | A | * | 2/1996 | Wood, III et al. | 313/141 |

* cited by examiner

*Primary Examiner*—Michael H. Day
*Assistant Examiner*—Kevin Quarterman
(74) *Attorney, Agent, or Firm*—Stetina Brunda Garredd & Brucker

(57) ABSTRACT

In accordance with the present invention, there is provided a spark plug for producing a plurality of sparks which define a three-dimensional volume in a combustion chamber of an internal combustion engine. The spark plug is provided with an insulative body having a support end. The spark plug is further provided with a central positive electrode which extends through the insulative body. The central positive electrode has a spark ignition end. The spark plug is further provided with a conductive outer shell which is disposed about the insulative body. The spark plug is further provided with at least two neutral electrodes which are attached to the support end of the insulative body. One of the neutral electrodes is adjacent to the spark ignition end of the central positive electrode and spaced apart therefrom to form a spark gap therebetween. Another one of the neutral electrode is adjacent to the conductive outer shell and spaced apart therefrom to form a spark gap therebetween. The neutral electrodes are spaced apart from one another to form spark gaps between each other. The exposed end of the central positive electrode and the neutral electrodes define a three-dimensional volume.

13 Claims, 2 Drawing Sheets

THREE-DIMENSIONAL MULTIPLE SERIES GAP SPARK PLUG

This is a continuation of Application Ser. No. 09/158,762 filed on Sep. 23, 1988, now abandoned.

FIELD OF THE INVENTION

The present invention relates generally to spark plugs for use with internal combustion engines, and more particularly to a spark plug having electrodes and spark gaps therebetween which define a three-dimensional volume.

BACKGROUND OF THE INVENTION

Most internal combustion engines utilize a spark plug for initiating combustion of the air/fuel mixture in the combustion chamber. The spark produced by the spark plug will ignite the air fuel mixture local to the spark gap if it is within an acceptable range near the stoichiometric ratio for the particular fuel utilized. The probability that the mixture will be ignited will be reduced when the mixture within the gap is excessively fuel rich or fuel lean. The engine's fuel delivery system will attempt to maintain the overall air/fuel ratio within an acceptable range. However, due to unavoidable inhomogeneity of the mixture within the combustion chamber, the probability of ignition of the mixture by a spark will vary spatially. If a spark is not produced in an optimal air/fuel region within the chamber, a misfire will occur, resulting in expulsion of the unburned air-fuel mixture from the combustion chamber without any production of power, which in turn results in increased emissions and decreased engine efficiency. This condition will be aggravated when the overall fuel/air ratio is fuel-lean; as in lean-burn engines, since this will tend to increase the number of excessively fuel-lean regions within the combustion chamber. Furthermore, the regions of optimal air/fuel ratio within the combustion chamber may change with time.

The probability of igniting the mixture can be increased by supplying a multiplicity of sparks within the combustion chamber each time ignition is required. This can be accomplished by employing two or more conventional single-gap spark plugs within each combustion chamber or employing a multiple-gap or multiple-electrode spark plug to produce more than one spark at a time. However, there are practical limits to the number of spark plugs that can be utilized in each combustion chamber, and there are subtle design issues for multiple-electrode spark plugs which must be considered in order to maximize their performance relative to conventional spark plugs.

The initial stage in the combustion of the air-fuel mixture is called the ignition delay period and is generally defined by the formation of a stable flame front from the spark. The spark ignites the mixture, producing a small ball of flame called the flame kernel. The flame kernel is small and unstable and may become extinguished if the conditions for combustion are not optimal, resulting in a misfire. The flame kernel grows and becomes more stable as it burns more of the mixture, eventually becoming a hollow sphere of flame known as a flame front. Because the amount of fuel burned versus time is an exponential function, the ignition delay period is usually a large fraction of the total combustion time, sometimes as much as 50%. Significant decreases in total combustion time can therefore be realized by decreasing the ignition delay time.

It is desirable to decrease combustion time because significant increases in thermodynamic efficiency of the combustion process can be made by decreasing the combustion time of the mixture resulting in improved fuel efficiency, increased power, and reduced emissions.

One of the best ways to reduce the ignition delay time is to produce a larger spark. This produces a more stable flame kernel, which will eventually become a stable lame front in less time than those formed via a smaller spark. Again, this is more beneficial for lean fuel/air ratios which cause longer ignition delay times. The size of a single spark, however, is limited by available ignition energy and geometric constraints of a standard, single gap spark plug.

It is therefore evident that there exists a need in the art for a spark plug which provides multiple sparks forming a three-dimensional volume for reducing combustion time and mitigating ignition misfires, increasing engine power and efficiency, and decreasing fuel consumption.

SUMMARY OF THE INVENTION

In accordance with the present invention, there is provided a spark plug for producing a plurality of sparks which define a three-dimensional volume in a combustion chamber of an internal combustion engine. The spark plug is provided with an insulative body having a support end. The spark plug is further provided with a central positive electrode which extends through the insulative body. The central positive electrode has a spark ignition end. The spark plug is further provided with a conductive outer shell which is disposed about the insulative body. The spark plug is further provided with at least two neutral electrodes which are attached to the support end of the insulative body. One of the neutral electrodes is adjacent to the spark ignition end of the central positive electrode and spaced apart therefrom to form a spark gap therebetween. Another one of the neutral electrodes is adjacent to the conductive outer shell and spaced apart therefrom to form a spark gap therebetween. The neutral electrodes being spaced apart from one another to form spark gaps between each other. The spark gaps thus defined in turn define a three-dimensional volume.

In practice, the spark plug of the present invention facilitates the formation of an electrical circuit. In this respect, electrical current may be applied to the central positive electrode and may flow to the spark ignition end thereof. Such current may continue to flow to the neutral electrodes by traversing the spark gaps therebetween in the form of a spark. The electrical circuit is completed as a spark traverses from a neutral electrode to the conductive outer shell which functions as a source of electrical ground.

Preferably, the central positive electrode defines a longitudinal axis and adjacent ones of the neutral electrodes being disposed radially progressively further away from the longitudinal axis of the central positive electrode. In addition, the central positive electrode has an electrical connection end and adjacent ones of the neutral electrodes are progressively further away from the spark ignition end of the central positive electrode generally towards the electrical connection end of the central positive electrode. In this respect, the spark ignition end of the central positive electrode and the neutral electrodes are configured along a generally spiral helix path so as to facilitate the formation of sparks across the respective spark gaps substantially along the spiral helix path.

As such, based on the foregoing, the present invention mitigates the inefficiencies and limitations associated with prior art spark plugs. The present invention is particularly adapted to facilitate the generation of a series of sparks which define a three-dimensional volume. In this respect, it is contemplated that the sparks may quickly merge so as to form a large flame front which reduces combustion time and mitigates ignition misfires, thereby facilitating an increase in engine power and efficiency and a decrease in fuel consumption and emission.

Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
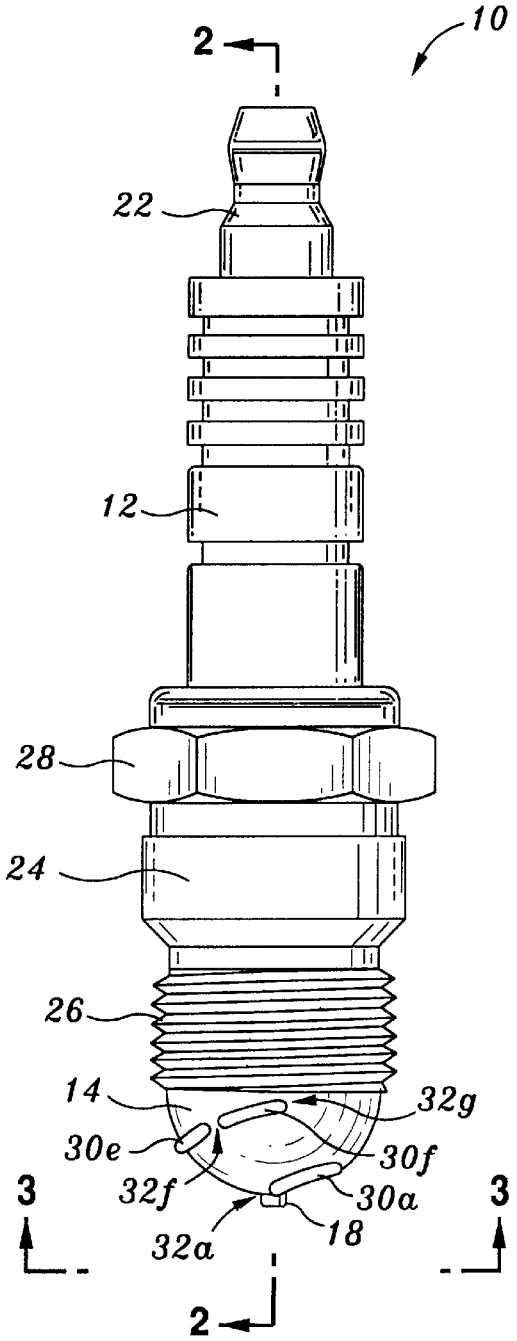
FIG. 1 depicts a side view of the spark plug of the present invention.
Figure 2:
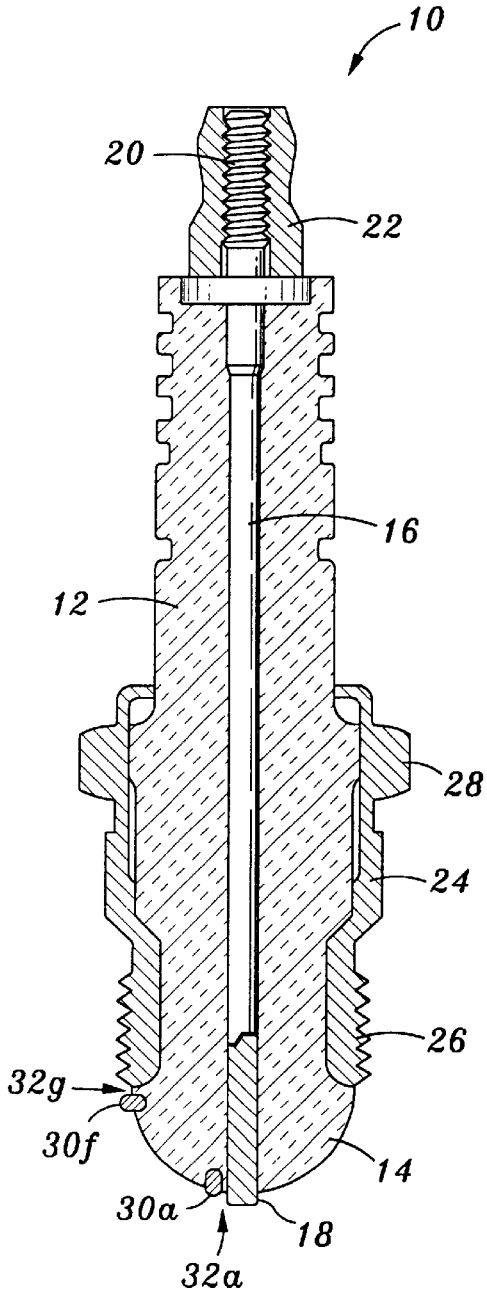
FIG. 2 depicts a cross-sectional view of the spark plug of FIG. 1 as seen along axis 2—2.
Figure 3:
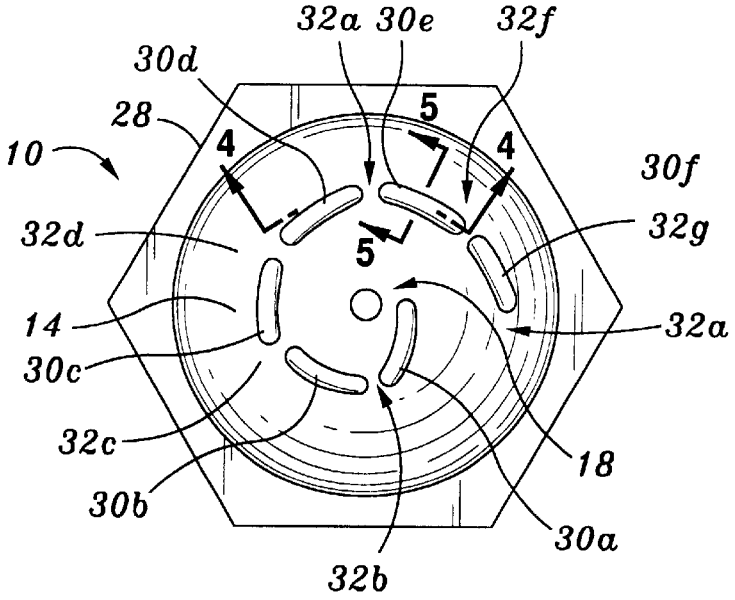
FIG. 3 depicts an end view of the spark plug of FIG. 1 as seen along axis 3—3.
Figure 4:
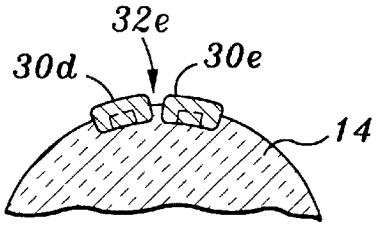
FIG. 4 depicts a partial cross-sectional view of the spark plug of FIG. 3 as seen along axis 4—4.

Referring now to the drawings wherein the information shown is for purposes of illustrating a preferred embodiment of the present invention only, and not for purposes of limiting the same, FIGS. 1–8 illustrate a spark plug for producing a plurality of sparks which define a three-dimensional volume constructed in accordance with the present invention.

In accordance with the present invention, there is provided a spark plug 10 for producing a plurality of sparks which define a three-dimensional volume in a combustion chamber of an internal combustion engine. The spark plug 10 is provided with an insulative body 12 having a support end 14.

The spark plug 10 is further provided with a central positive electrode 16 having a spark ignition end 18 and an electrical connection end 20. Preferably, the central positive electrode 16 extends through the insulative body 12 with the spark ignition end 18 and the electrical connection end 20 protruding beyond the insulative body 12 in opposing directions along the longitudinal axis of the spark plug. The central positive electrode 16 is generally elongate and defines a longitudinal axis of the spark plug. The electrical connection end 20 facilitates connection to a source of electrical current. In this respect the central positive electrode 16 is formed of a suitable material chosen from those well known to one of ordinary skill in the art so as to facilitate conduction of electrical current. The electrical connection end 20 may be fitted with an adapter 22 to further facilitate electrical connection to a source of electrical current.

The spark plug 10 is further provided with a conductive outer shell 24 disposed about the insulative body 12. In this respect the insulative body 12 electrically insulates the central positive electrode 16 from having direct electrical contact with the conductive outer shell 24. As is typical with most common spark plugs, the conductive outer shell 24 may be provided with a threaded portion 26 for connection with the support structure of an internal combustion engine (not shown). Further, as is typical with most common spark plugs, the conductive outer shell 24 may be provided with engagement portion 28 for facilitating tool engagement (e.g., a wrench) of the spark plug 10 for threadily engaging the threaded portion 26 of the conductive outer shell 24 via a turning or screwing motion of the spark plug 10 about its longitudinal axis.

The spark plug 10 is further provided with at least two neutral electrodes which are attached to the support end 14 of the insulative body 12. One of the neutral electrodes 30*a* is adjacent to the spark ignition end 18 of the central positive electrode 16 and is spaced apart therefrom to form a spark gap 32*a* therebetween. Another one of the neutral electrodes 30*f* is adjacent to the conductive outer shell 24 and spaced apart therefrom to form a spark gap 32*g* therebetween. Additional intermediate neutral electrodes 30*b*, 30*c*, 30*d*, 30*e* may be provided at best seen in FIG. 3.

Importantly, it is contemplated that the spark ignition end 18 of the central positive electrode 16 and the neutral electrodes 30 are sized and configured to define a three-dimensional volume. In this respect, series of spark gaps 32 are formed therebetween which facilitate the formation of a series of sparks to be generated across the spark gaps 32. It is contemplated that such a series of sparks may quickly merge to form large stable flame front for ignition.

In practice, the spark plug 10 of the present invention facilitates the formation of an electrical circuit. In this respect, electrical current may be applied to the electrical connection end 20 of the central positive electrode 16 and may flow to the spark ignition end 18 thereof. Such current may continue to flow progressively to the neutral electrodes 30*a–f* by traversing the spark gaps 32*a–g* therebetween in the form of sparks The electrical circuit is completed as a spark traverse from the last neutral electrode 32*g* to the conductive outer shell 24 which functions as a source of electrical ground. As one of ordinary skill in the art will appreciate, the size, shape, material selection and relative positioning of the spark ignition end 18 of the central positive electrode 16, the neutral electrodes 30 and the conductive outer shell 24 will impact upon the propensity of sparks traversing the spark gaps 32.

In the preferred embodiment of the present invention, adjacent ones of the neutral electrodes 30 are disposed progressively further away from the spark ignition end 18 of the central positive electrode 16. In this respect, adjacent ones of the neutral electrodes 30 are radially progressively further away from the longitudinal axis of the central positive electrode 16. In addition, adjacent ones of the neutral electrodes 30 are progressively further away from the spark ignition end 18 of the central positive electrode 16, generally towards the electrical connection end 20 thereof. The spark ignition end 18 of the central positive electrode 16 and the neutral electrodes 30 may be configured along a generally spiral helix path so as to facilitate the formation of sparks across the respective spark gaps 32 substantially along the spiral helix path. The support end 14 of the insulative body 12 is formed to be generally dome-shaped so as to facilitate structural support of the neutral electrodes 30 along such a spiral helix path.

Figure 5:
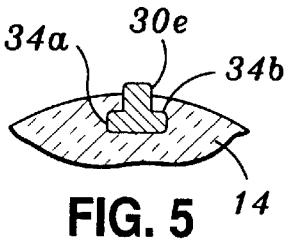
FIG. 5 depicts a partial cross-sectional view of the spark plug of FIG. 3 as seen along axis 5—5.
Figure 6:
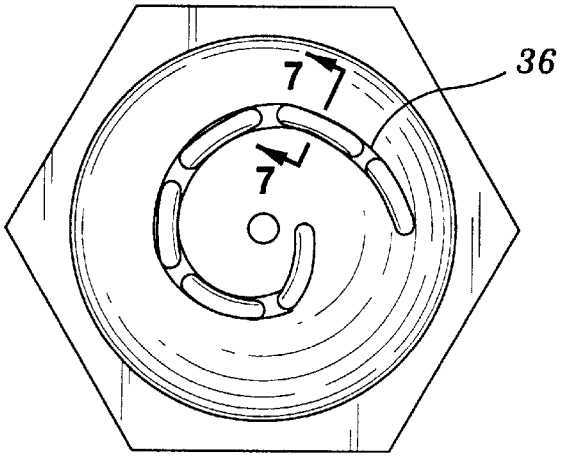
FIG. 6 depicts an end view of an alternate embodiment of the spark plug of the present invention.
Figure 7:
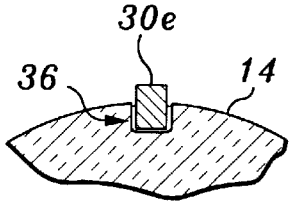
FIG. 7 depicts a partial cross-sectional view of the alternate embodiment of the spark plug of FIG. 6 as seen along axis 7—7.
Figure 8:
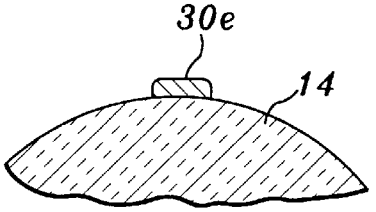
FIG. 8 depicts a partial cross-sectional view similar to that of FIGS. 5 and 7, however, depicting a further alternate embodiment of the spark plug of FIG. 3 as seen along axis 5—5.

In addition, the neutral electrodes 30 may be formed to be generally elongate and having a curvature. It is contemplated that such a curvature follows the spiral helix path. The neutral electrodes 30 may be further formed to a variety of cross-sections and may be engaged with the support end 14 of the insulative body 12 in a variety of different methods. For example, the neutral electrodes 30 may have a generally rectangular cross-section and may be attached, cemented or otherwise directly bonded to the surface of the support end 14 of the insulative body 12, as shown in FIG. 8. Alternately, the neutral electrodes 20 may be imbedded into the support end 14 of the insulative body 12, as shown in FIGS. 5 and 7. In this respect, a channel 36 may be formed in the support end 14 of insulative body 12 for receiving the neutral electrodes 30. The neutral electrodes 30 may be formed to have flanged portions 34*a–b* thereof in order to facilitate secure attachment of the neutral electrodes 30 to the support end 14 of the insulative body 12. It is contemplated that the neutral electrodes 30 may be pre-formed and attached to the insulative body 12 during or after the formation of the insulative body or formed insitu via an electro-plating, deposition, evaporation, silkscreening process or painting processes or other methods which are well known to one of ordinary skill in the art.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A spark plug for producing a plurality of sparks which define a three-dimension volume in a combustion chamber of an internal combustion engine, the spark plug comprising:

an insulative body having support end;

a central positive electrode extending through the insulative body and having a spark ignition end;

a conductive outer shell disposed about the insulative body;

a plurality of neutral electrodes formed on a continuous and curved surface of the support end of the insulative body, wherein a first one of the neutral eLectrode being adjacent the spark ignition end of the central positive electrode and spaced apart therefrom to form a spark gap therebetween, a last one of the neutral electrode being directly adjacent the conductive outer conductive shell and spaced apart therefrom to form a spark gap therebetween, and the neutral electrodes are adjacent and spaced apart from each other to form a series of spark gaps extending three-dimensionally from the spark ignition end to the conductive outer shell.

2. The spark plug of claim 1 wherein adjacent ones of the neutral electrodes being disposed progressively further away from the spark ignition end of the central positive electrode to facilitate formation of a series sparks defining a three dimensional volume.

3. The spark plug of claim 2 wherein the central positive electrode having a longitudinal axis, adjacent ones of the neutral electrodes being disposed progressively radially further away from the longitudinal axis of the central positive electrode to facilitate formation of a series sparks formed in three dimensions.

4. The spark plug of claim 3 wherein the central positive electrode having an electrical connection end, adjacent ones of the neutral electrodes being disposed progressively further away from the spark ignition end of the central positive electrode generally towards the electrical connection end of the central positive electrode.

5. The spark plug of claim 4 wherein the spark ignition end of the central positive electrode and the neutral electrodes being cooperatively sized and configured along a generally spiral helix path so as to facilitate the formation of sparks across the respective spark gaps substantially along the spiral helix path.

6. The spark plug of claim 1 wherein the neutral electrodes are generally elongate and conform the curvature the continuous and curved surface of the support end.

7. The spark plug of claim 6, wherein the neutral electrodes have a curvature along to the curvature of the continuous and curved surface of the support end.

8. The spark plug of claim 7 wherein the neutral electrodes being disposed along the spiral helix path.

9. The spark plug of claim 1 wherein the support end of the insulative body having a channel disposed therein and the neutral electrodes being disposed within the channel.

10. The spark plug of claim 1, wherein the neutral electrodes further comprise electroplated electrodes.

11. The spark plug of claim 1, wherein the neutral electrodes further comprise silk-screened electrodes.

12. The spark plug of claim 1, wherein the neutral electrodes further comprise painted electrodes.

13. The spark plug of claim 1, wherein the neutral electrodes further comprise electrodes cemented the support end of the insulative body.

* * * * *